United States Patent [19]

Tomita et al.

[11] Patent Number: 4,938,266

[45] Date of Patent: Jul. 3, 1990

[54] METHOD OF PRODUCING STEEL HAVING A LOW YIELD RATIO

[75] Inventors: Yukio Tomita; Ryohta Yamaba; Takeshi Tsuzuki, all of Tokai, Japan

[73] Assignee: Nippon Steel Corporation, Tokyo, Japan

[21] Appl. No.: 282,043

[22] Filed: Dec. 9, 1988

[30] Foreign Application Priority Data

Dec. 11, 1987 [JP] Japan ..... 62-312304
Dec. 11, 1987 [JP] Japan ..... 62-312305

[51] Int. Cl.[5] ..... C21D 8/00
[52] U.S. Cl. ..... 148/12 F; 148/12.4
[58] Field of Search ..... 148/12 F, 12.4

[56] References Cited

FOREIGN PATENT DOCUMENTS 4608 1/1981 Japan .
60-56019 4/1985 Japan ..... 148/12 F
61-15918 1/1986 Japan ..... 148/12 F

*Primary Examiner*—Deborah Yee
*Attorney, Agent, or Firm*—Wenderoth, Lind & Ponack

[57] ABSTRACT

A method of producing steel plate having a low yield ratio and high strength and a dual-phase mixed microstructure of ferrite and second-phase carbide comprises heating to at least 950° C. low-carbon slab steel having 0.30% or less carbon, 0.05 to 0.60% silicon, 0.5 to 2.5% manganese, and 0.01 to 0.10% aluminum as the basic components, with the balance being iron and unavoidable impurities, or low-carbon low-alloy slab steel comprising in addition to the above basic components one or more elements selected from copper, nickel, chromium, molybdenum, niobium, vanadium, titanium, boron and calcium, hot rolling it, reheating it and tempering it.

6 Claims, 1 Drawing Sheet

METHOD OF PRODUCING STEEL HAVING A LOW YIELD RATIO

BACKGROUND OF THE INVENTION

1. Field of the Invention

This invention relates to a method of producing steel having a low yield ratio.

2. Description of the Prior Art

In recent years, in various fields such as the shipbuilding industry and the industrial machinery industry there is an increasing demand for steels that enable welding operations to be reduced and properties such as bendability to be pursued to the limit, have better weldability and which will enable steel costs to be lowered.

Of these, in order to improve the bendability of steel plate it is necessary to develop plate that possesses a low yield ratio. Low-yield-ratio steel is also desirable for improving the safety of structures such as buildings and bridges, especially the earthquake resistance of such structures.

In conventional controlled rolling, controlled cooling process, to achieve improved low-temparature toughness, in the hot-rolling the ferrite grains are made as small as possible and accelerated cooling from the austenitic single phase is employed.

However, a problem with this method is that the yield point rises due to the refinement of the ferrite grains, the hardening and the formation of part of the pearlite into bainite, resulting in a higher yield ratio that reduces the bendability.

In methods for lowering the yield point using a controlled rolling, controlled cooling process, there has also been proposed a method of producing steel having a low yield ratio whereby a low yield point is achieved together with good low-temperature toughness provided by a fine-grain ferritic structure. However, the need for still lower yield ratios has continued to grow.

JP-B-No. 56(1971)-4608 proposes low-temperature toughness steel containing 4.0 to 10% nickel for use as a material for liquid natural gas containers.

SUMMARY OF THE INVENTION

The object of the present invention is to provide a method of producing low-yield-ratio steel plate possessing a high minimum strength of 50 kg/mm$^2$ and good bendability.

DETAILED DESCRIPTION OF THE INVENTION

Figure 1:
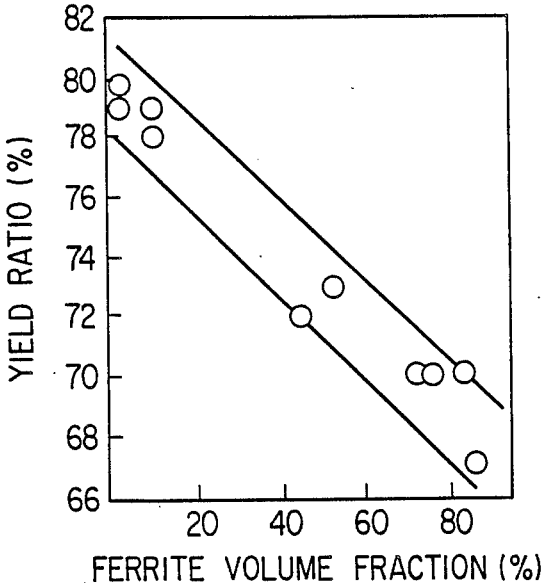
FIG. 1 is a graph showing the relationship between ferrite volume fraction and yield ratio.

The present inventors found that in order to lower the yield ratio the steel should be given a two-phase mixed microstructure of ferrite and second-phase carbide. To lower the yield ratio even further, it is important to lower the yield point and raise the tensile strength.

Specifically, when increasing the ferrite volume fraction to lower the yield point, it is important not to make the grains any finer than is necessary, and when tempering the second-phase carbide (bainite or martensite) that has been hardened by the quenching in order to raise the tensile strength, it is also important not to reduce the hardness any more than is required.

As can be seen from FIG. 1 showing the relationship between ferrite volume fraction and yield ratio, an increase in the ferrite volume fraction is accompanied by a sharp decrease in the yield ratio.

The present invention is based on this finding and enables steel with a low yield ratio to be manufactured. The starting material for the present invention is low-carbon steel slab having a composition consisting essentially, by weight, of Carbon: 0.30% or less
Silicon: 0.05 to 0.60%
Manganese: 0.5 to 2.5%
Aluminum: 0.01 to 0.10% as the basic components, with the balance being iron and unavoidable impurities.

The present invention also employs low-carbon low-alloy steel slab having a composition consisting essentially, by weight, of Carbon: 0.30% or less
Silicon: 0.05 to 0.60%
Manganese: 0.5 to 2.5%
Aluminum: 0.01 to 0.10% as the basic components and which also contains one or two or more elements selected from among a group of hardness-improvement elements consisting of Copper: 2.0% or less
Nickel: less than 4.0%
Chromium: 5.5% or less
Molybdenum: 2.0% or less
Niobium: 0.15% or less
Vanadium: 0.3% or less
Titanium: 0.15% or less
Boron: 0.0003 to 0.0030% and calcium having an inclusion shape control action, with the balance being iron and unavoidable impurities.

The invention is characterized by heating the slab of low carbon steel or low carbon, low alloy steel to a temperature of 950° to 1250° C., hot rolling it, rapid cooling it to a temperature not exceeding 250° C., reheating it to a temperature of $Ac_1+20°$ C. to $Ac_1+80°$ C., water-cooling it and then tempering it at a temperture range of 200° to 600° C.

The $Ar_3$ (°C.) used in the present invention is obtained as follows.

$Ar_3$(°C.)=868−369. C(wt %)+24.6. Si(wt %)−68.1. Mn(wt %)−36.1. Ni(wt %)−20.7. Cu(wt %)−24.8. Cr(wt %)+29.6. Mo(wt %)

The reasons for the component limitations are as follows.

Carbon is required to ensure the strength of the steel, but if there is too much carbon it will impair the toughness and weldability of the steel, so a maximum of 0.30% is specified. At least 0.05% silicon is required for deoxidation, but adding too much silicon will cause a loss of weldability, so a maximum of 0.60% is specified. Manganese is a useful additive for increasing the strength of the steel at low cost; to ensure the strength, at least 0.5% is required, but too much manganese will cause a loss of weldability, so a maximum of 2.5% is specified. At least 0.01% aluminum is required for deoxidation, but as too much aluminum will produce excessive inclusions, degrading the properties of the steel, a maximum of 0.1% is specified.

Copper is a useful additive for raising the strength and corrosion-resistance of the steel; however, adding it in amounts over 2.0% produces negligible increases in strength, so an upper limit of 2.0% is specified. Nickel is added because it improves low-temperature toughness and raises the strength by improving the hardenability; an amount of less than 4.0% is specified because it is an expensive element. Chromium is added to raise the strength of the steel, but too much chromium will adversely affect low-temperature toughness and weldability, so a maximum of 5.5% is specified. Molybdenum is a useful additive for raising the strength of the steel; however, too much molybdenum will reduce weldability, so an upper limit of 2.0% is specified. Niobium, like titanium, is useful for producing austenite grain refinement, but as too much niobium reduces the weldability, an upper limit of 0.15% is specified. Vanadium aids precipitation hardening, but as too much vanadium will reduce weldability, an upper limit of 0.3% is specified. Titanium is useful for producing austenite grain refinement, but too much titanium will reduce weldability, so an upper limit of 0.15% is specified.

Boron, added in minute amounts, produces a marked improvement in the hardenability of the steel. To usefully obtain this effect it is necessary to add at least 0.0003% boron. However, adding too much boron causes the formation of boron compounds, degrading the toughness, and therefore an upper limit of 0.0030% is specified.

Calcium is used for shape control of sulfide-system inclusions, but adding too much calcium will cause inclusions to form, degrading the properties of the steel, so an upper limit of 0.006% is specified.

In the method of this invention a slab heating temperature of 950° to 1250° C. is specified; preferably the heating temperature is on the high side, and only recrystallization rolling is employed or the cumulative reduction ratio is lowered, in the case of also non-recrystallization-zone rolling. By doing this, ensuring the grains are not made finer than necessary, then heating on the low side between the transformation points $Ac_1$ and $Ac_3$ and water-cooling from that temperature produces a major increase in the ferrite volume fraction.

Also lowering the tempering temperature prevents excessive softening of second phase portions. The synergistic effect of this makes it possible to produce steel having a low yield ratio. (hereinafter this will be referred to as "Process A".)

Process A of this invention will now be discussed below.

A lower limit of 1050° C. has been specified for the slab heating temperature so that the austenite grains are not made finer than necessary during the heating. As raising the temperature to a higher level has no qualitative effect on the material, and in fact is inexpedient with respect to energy conservation, an upper limit of 1250° C. is specified.

Rolling is divided into rolling at over 900° C. and rolling at a maximum of 900° C. In view of the uses to which low-yield-ratio steel sheet is put, sufficient toughness is obtained with controlled rolling at temperatures over 900° C., and as such it is preferable that rolling is completed at a temperature of over 900° C., so a lower limit of 950° C. is specified.

With a heating temperature range of 1050° to 1250° C., when the drop in temperature that occurs during the rolling is taken into account, the temperature at the finish of the rolling will be no higher than 1050° C., so an upper limit of 1050° C. is specified.

Also, in the case of rolling that finishes at a temperature of 900° C. or below, a cumulative reduction of 30% or more in controlled rolling at 900° C. or lower produces excessive reduction in the size of the ferrite grains and pulverization of the second phase carbide, which results in a higher yield ratio.

In the case of rolling that finishes between 900° C. and $Ar_3$, a cumulative reduction ratio, between 900° C. and $Ar_3$, of less than 30% of the finish thickness is specified. A lower limit of 5% has been specified to ensure that the effect of the hot rolling reaches far enough into the steel.

The reason for specifying 250° C. as the temperature at which to stop the accelerated cooling that follows the rolling is that if the cooling is stopped at a temperature over 250° C., the subsequent tempering heat-treatment produces a slight reduction in strength together with a degradation of the low-temperature toughness.

To ensure that the steel is cooled uniformly, the accelerated cooling is preferably conducted using a minimum water volume density of 0.3 $m^3/m^2$. minute.

A reheating temperature range of at least $Ac_1+20°$ C. to a maximum of $Ac_1+80°$ C. is specified because heating in this range produces a large improvement in the ferrite volume fraction. Namely, at exactly $Ac_1$ the transformation has not made sufficient progress and hardening of the second phase carbide is inadequate. However, at $Ac_1+20°$ C. or over the transformation has made sufficient progress and hardening of the second phase portion is also adequate.

Increasing the heating temperature over $Ac_1+80°$ C. is accompanied by a decrease in the ferrite volume fraction. Above $Ac_1+80°$ C. the ferrite volume fraction required to obtain the low yield ratio that is the object of the invention can no longer be obtained; this is the reason for specifying a reheating temperature of at least $Ac_1+20°$ C. to a maximum of $Ac_1+80°$ C. The limitation is made lower than the mid-point of the range $Ac_1$ to $Ac_3$ because heating at a temperature nearer to the $Ac_1$ produces an increase in the ferrite portion of the ferrite-to-austenite volume fraction and this state is solidified by the following rapid cooling, providing an increased ferrite volume fraction and a low yield ratio.

Water-cooling after reheating at $Ac_1+20°$ C. to $Ac_1+80°$ C. is done to ensure that the portions where there are concentrations of carbon austenitized during the reheating are adequately hardened when formed into a hardened.structure, increase tensile strength and obtain a low yield ratio. Regarding water-cooling conditions, soaking or roller quenching may be used to readily obtain a hardened structure.

An upper temperature of 600° C. is specified for the tempering. The reason for this is that, with respect to the mixed dual-phase structure of ferrite and second-phase carbide, too high a tempering temperature will produce excessive softening of second-phase portions that were sufficiently hardened by the preceding water-cooling, which will lower the tensile strength and raise the yield ratio. However, if the tempering temperature goes too low, below 200° C., there is almost no tempering effect and toughness is decreased.

Another preferred set of heating and rolling conditions according to the invention will now be discussed below. (Hereinafter this will be referred tp as "Process B".)

With Process B, the heating temperature is made on the low side and in the hot rolling, non-recrystallization-zone rolling as well as recrystallization rolling are employed, and the cumulative reduction ratio is raised to reduce the size of the grains. This is followed by heating on the low side between the transformation points $Ac_1$ and $Ac_3$ and water-cooling from that temperature, producing a major increase in the ferrite volume fraction.

Also lowering the tempering temperature prevents excessive softening of second phase portions. The synergistic effect of this makes it possible to produce steel having a low yield ratio.

That is, an upper limit of 1150° C. has been specified for the heating temperature to reduce the size of the austenite grains, and 950° C. is specified for the lower limit as being a temperature that provides sufficient heating with respect to the austenite grains.

Regarding the rolling, in order to obtain good low-temperature toughness, with the aim of producing grain refinement, controlled rolling is conducted at 900° C. or below with a cumulative reduction of at least 30%. The upper limit is 70%, at which the rolling effect reaches saturation. The reason for specifying 250° C. or lower as the temperature at which to stop the accelerated cooling is that if the cooling is stopped at a higher temperature zone of over 250° C., the subsequent tempering heat-treatment produces a slight reduction in strength together with a degradation of the low-temperature toughness. To ensure that the steel is cooled uniformly, the accelerated cooling is preferably conducted using a minimum water volume density of 0.3 $m^3/m^2$ . minute. The same reheating conditions, cooling conditions and tempering as those of Process A may be used.

EXAMPLE 1

Table 1 shows the chemical compositions of the samples, and Table 2 shows the heating, rolling, cooling and heat-treatment conditions and the mechanical properties of the steel thus obtained.

Steels A, G, H, I, J, K, L, M, N, O and P have a component system for a treatment strength grade of 50 $kg/mm^2$; that of steels B, C, D, E, F, Q, R, S, T and U is for a target strength grade of 60 $kg/mm^2$, and that of V is for a target strength grade of 80 $kg/mm^2$. As shown in Table 2, steels A1, A9, B1, C1, D1, E1, F1, G1, H1, I1, J1, K1, L1, M1, N1, O1, P1, Q1, R1, S1, T1, U1 and V1 are embodiments of the present invention, and attained the target low yield ratio, according to the invention, of 70% or below, with adequate strength for their respective grades 50 $kg/mm^2$, 60 $kg/mm^2$ and 80 $kg/mm^2$ and good toughness.

In contrast, the yield ratio of steel A2 has been increased by a reheating temperature that was too low. Steel A3 has a high yield ratio caused by the cumulative reduction ratio between 900° C. and $Ar_3$ being too high. In A4, toughness has been reduced because the temperature at which cooling was stopped is too high. The high yield ratio in A5 is the result of the reheating temperature being too low, while in A6 it is the result of too high a reheating temperature. In A7 an excessively-high tempering temperature caused the high yield ratio. In A8, the lack of tempering has reduced the toughness. The high yield ratio of B2 is caused by an excessively-high reheating temperature, and in the case of B3 by an excessively-high tempering temperature.

EXAMPLE 2

Table 3 shows the chemical compositions of the samples, and Table 4 shows the heating, rolling, cooling and heat-treatment conditions and the mechanical properties of the steel thus obtained.

Steels a, g, h, i, j, k, l, m, n, o and p have a component system for a target strength grade of 50 $kg/mm^2$; that of steels b, c, d, e, f, q, r, s, t and u is for a target strength grade of 60 $kg/mm^2$, and that of v is for a target strength grade of 80 $kg/mm^2$. As shown in Table 2, steels a1, a9, b1, c1, d1, e1, f1, g1, h1, i1, j1, k1, l1, m1, n1, o1, p1, q1, r1, s1, t1, u1 and v1 are embodiments of the present invention, and attained the target low yield ratio, according to the invention, of 70% or below, with adequate strength for their respective grades 50 $kg/mm^2$, 60 $kg/mm^2$ and 80 $kg/mm^2$ and good low-temperature toughness ($vTrs \leqq -80°$ C.).

In contrast, the low-temperature toughness of steel a2 has been reduced by a reheating temperature that was too low. Low-temperature toughness of steel has been reduced because the cumulative reduction ratio between 900° C. and $Ar_3$ was too low in the case of a3; in a4, toughness has been reduced because the temperature at which cooling was stopped is too high. The yield ratio is high because the reheating temperature was too low in the case of a5, too high in the case of a6, and because of an excessively-high tempering temperature in the case of a7. In a8, the lack of tempering has reduced the toughness. The yield ratio is high because of an excessively-high reheating temperature in the case of b2, and because of an excessively-high tempering temperature in the case of b3.

TABLE 1

(wt %)

| | C | Si | Mn | P | S | Al | Cu | Ni |
|---|---|---|---|---|---|---|---|---|
| A | 0.08 | 0.24 | 1.44 | 0.017 | 0.004 | 0.035 | — | — |
| B | 0.10 | 0.22 | 1.41 | 0.015 | 0.003 | 0.031 | 0.28 | 0.27 |
| C | 0.10 | 0.24 | 1.46 | 0.011 | 0.003 | 0.033 | — | 0.33 |
| D | 0.08 | 0.24 | 1.41 | 0.010 | 0.002 | 0.035 | 1.51 | — |
| E | 0.07 | 0.21 | 1.10 | 0.005 | 0.002 | 0.031 | — | 3.49 |
| F | 0.08 | 0.24 | 1.36 | 0.013 | 0.003 | 0.033 | — | — |
| G | 0.08 | 0.23 | 1.02 | 0.014 | 0.004 | 0.032 | — | — |
| H | 0.07 | 0.25 | 1.26 | 0.012 | 0.003 | 0.036 | — | — |
| I | 0.08 | 0.23 | 1.28 | 0.009 | 0.004 | 0.033 | — | — |
| J | 0.07 | 0.24 | 1.21 | 0.015 | 0.003 | 0.030 | — | — |
| K | 0.08 | 0.21 | 1.44 | 0.010 | 0.003 | 0.035 | — | — |
| L | 0.07 | 0.24 | 1.36 | 0.014 | 0.004 | 0.033 | 0.25 | 0.20 |
| M | 0.07 | 0.31 | 1.35 | 0.012 | 0.003 | 0.038 | — | — |
| N | 0.08 | 0.29 | 1.31 | 0.013 | 0.004 | 0.035 | — | — |
| O | 0.08 | 0.24 | 1.37 | 0.009 | 0.003 | 0.033 | — | — |
| P | 0.08 | 0.26 | 1.35 | 0.011 | 0.003 | 0.036 | 0.20 | 0.25 |
| Q | 0.10 | 0.24 | 1.56 | 0.016 | 0.004 | 0.035 | — | 0.45 |
| R | 0.11 | 0.23 | 1.37 | 0.011 | 0.003 | 0.036 | — | — |
| S | 0.10 | 0.22 | 1.56 | 0.013 | 0.003 | 0.031 | 0.30 | 0.15 |
| T | 0.10 | 0.27 | 1.39 | 0.011 | 0.003 | 0.036 | 0.21 | 0.31 |
| U | 0.10 | 0.24 | 1.55 | 0.010 | 0.003 | 0.031 | — | — |
| V | 0.12 | 0.25 | 0.85 | 0.008 | 0.003 | 0.060 | 0.17 | 0.10 |

| | Cr | Mo | Nb | V | Ti | Ca | B |
|---|---|---|---|---|---|---|---|
| A | — | — | — | — | — | — | — |
| B | 0.10 | — | 0.023 | — | — | — | — |
| C | — | 0.20 | 0.025 | — | 0.012 | 0.0040 | — |
| D | — | — | — | — | — | — | — |
| E | — | — | — | — | — | — | — |
| F | 1.20 | — | — | — | — | — | — |
| G | — | 0.55 | — | — | — | — | — |
| H | — | — | 0.09 | — | — | — | — |
| I | — | — | — | 0.08 | — | — | — |
| J | — | — | — | — | 0.12 | — | — |
| K | — | — | — | — | — | 0.0031 | — |
| L | — | — | — | — | — | — | — |
| M | 0.20 | 0.25 | — | — | — | — | — |
| N | — | — | 0.020 | 0.045 | — | — | — |
| O | — | — | 0.052 | — | 0.010 | — | — |
| P | — | — | 0.031 | — | — | — | — |
| Q | — | — | 0.030 | 0.055 | — | — | — |
| R | 0.20 | 0.18 | — | 0.043 | — | — | — |
| S | — | — | 0.018 | 0.042 | — | — | — |
| T | 0.15 | 0.29 | — | — | — | — | — |
| U | — | — | 0.041 | 0.063 | 0.020 | 0.0038 | — |
| V | 0.73 | 0.39 | — | — | — | — | 0.0010 |

TABLE 2

| | Steel No. | Steel gage (mm) | Heating temp. (°C.) | Finishing roll temp. (°C.) | 900° C.~$Ar_3$ Cumulative reduction (%) | Temp. at which cooling is stopped (°C.) | Cooling water volume density ($m^3/m^2$.min) | Reheating temp. (°C.) | Tempering temp. (°C.) | Yield point ($kg/mm^2$) | Tensile strengths ($kg/mm^2$) | Yield ratio (%) | vTrs (°C.) |
|---|---|---|---|---|---|---|---|---|---|---|---|---|---|
| This invention | A1 | 25 | 1150 | 850 | 10 | RT | 0.5 | 760 | 450 | 34.3 | 58.1 | 59 | −60 |
| Comparison | A2 | " | 950 | 800 | " | " | " | " | " | 41.0 | 56.2 | 72 | −81 |
| Comparison | A3 | " | 1150 | " | 40 | " | " | " | " | 43.1 | 58.3 | 74 | −75 |
| Comparison | A4 | " | " | " | " | 300 | " | " | " | 34.9 | 56.4 | 63 | −45 |
| Comparison | A5 | " | " | " | " | RT | " | 700 | " | 42.6 | 56.1 | 76 | −55 |
| Comparison | A6 | " | " | " | " | " | " | 880 | " | 43.4 | 55.6 | 78 | −58 |
| Comparison | A7 | " | " | " | " | " | " | 760 | 650 | 40.4 | 54.6 | 74 | −68 |
| Comparison | A8 | " | " | " | " | " | " | " | — | 30.8 | 60.3 | 51 | −5 |
| This invention | A9 | 65 | 1100 | 920 | 0 | " | " | " | 400 | 34.5 | 55.6 | 62 | −55 |
| This invention | B1 | 35 | 1250 | 850 | 10 | " | 0.7 | 770 | 450 | 41.3 | 64.5 | 64 | −59 |
| Comparison | B2 | " | " | " | " | " | " | 880 | " | 45.8 | 61.0 | 75 | −56 |
| Comparison | B3 | " | " | " | " | " | " | 760 | 650 | 46.7 | 61.5 | 76 | −62 |
| This invention | C1 | 45 | 1100 | 910 | 0 | <100 | " | 750 | 400 | 41.1 | 66.3 | 62 | −59 |
| This invention | D1 | 35 | " | " | " | " | " | " | " | 42.3 | 69.3 | 61 | −56 |
| This invention | E1 | " | " | " | " | " | " | " | " | 42.8 | 69.0 | 62 | −90 |
| This invention | F1 | " | " | " | " | " | " | " | " | 41.6 | 66.0 | 63 | −55 |
| This invention | G1 | 30 | 1150 | 850 | 10 | " | " | " | " | 35.0 | 56.5 | 62 | −52 |
| This invention | H1 | " | " | " | " | " | " | " | " | 35.7 | 56.7 | 63 | −57 |
| This invention | I1 | " | " | " | " | " | " | " | " | 34.4 | 55.5 | 62 | −52 |
| This invention | J1 | " | " | " | " | " | " | " | " | 34.0 | 55.8 | 61 | −54 |
| This invention | K1 | " | " | " | " | " | " | " | " | 34.5 | 56.5 | 61 | −60 |
| This invention | L1 | " | " | " | " | " | " | " | " | 35.2 | 55.8 | 63 | −57 |
| This invention | M1 | " | " | " | " | " | " | " | " | 34.8 | 55.2 | 63 | −54 |
| This invention | N1 | " | " | " | " | " | " | " | " | 35.5 | 56.3 | 63 | −58 |
| This invention | O1 | " | " | " | " | " | " | " | " | 34.6 | 54.9 | 63 | −56 |
| This invention | P1 | " | " | " | " | " | " | " | " | 36.3 | 58.5 | 62 | −59 |
| This invention | Q1 | 40 | 1100 | 800 | 20 | " | " | " | " | 41.9 | 66.5 | 63 | −58 |
| This invention | R1 | " | " | " | " | " | " | " | " | 41.2 | 65.4 | 63 | −58 |
| This invention | S1 | " | " | " | " | " | " | " | " | 42.5 | 68.6 | 62 | −55 |
| This invention | T1 | " | " | " | " | " | " | " | " | 40.9 | 64.9 | 63 | −58 |
| This invention | U1 | " | " | " | " | " | " | " | " | 42.0 | 67.7 | 62 | −61 |
| This invention | V1 | 30 | 1050 | 850 | 10 | " | 1.0 | 810 | 450 | 55.8 | 82.0 | 68 | −63 |

Remarks:
In this invention and comparison, steel sheet was cooled by water-cooling roller quenching after reheating.

TABLE 3

| | C | Si | Mn | P | S | Al | Cu | (wt %) Ni |
|---|---|---|---|---|---|---|---|---|
| a | 0.12 | 0.23 | 1.21 | 0.016 | 0.004 | 0.035 | — | — |
| b | 0.10 | 0.21 | 1.40 | 0.014 | 0.003 | 0.030 | 0.27 | 0.26 |
| c | 0.10 | 0.23 | 1.45 | 0.010 | 0.003 | 0.032 | — | 0.32 |

TABLE 3-continued

| | | | | | | | | |
|---|---|---|---|---|---|---|---|---|
| d | 0.08 | 0.24 | 1.40 | 0.009 | 0.002 | 0.035 | 1.50 | — |
| e | 0.07 | 0.20 | 1.09 | 0.005 | 0.002 | 0.030 | — | 3.48 |
| f | 0.08 | 0.23 | 1.35 | 0.012 | 0.003 | 0.033 | — | — |
| g | 0.08 | 0.22 | 1.01 | 0.013 | 0.004 | 0.031 | — | — |
| h | 0.07 | 0.24 | 1.25 | 0.011 | 0.003 | 0.036 | — | — |
| i | 0.08 | 0.23 | 1.27 | 0.009 | 0.004 | 0.032 | — | — |

TABLE 3-continued

| | | | | | | | | |
|---|---|---|---|---|---|---|---|---|
| j | 0.07 | 0.24 | 1.20 | 0.015 | 0.003 | 0.030 | — | — |
| k | 0.08 | 0.21 | 1.43 | 0.009 | 0.003 | 0.034 | — | — |
| l | 0.07 | 0.24 | 1.35 | 0.014 | 0.004 | 0.033 | 0.24 | 0.19 |
| m | 0.07 | 0.30 | 1.34 | 0.012 | 0.003 | 0.037 | — | — |
| n | 0.08 | 0.28 | 1.30 | 0.013 | 0.004 | 0.034 | — | — |
| o | 0.08 | 0.24 | 1.36 | 0.009 | 0.003 | 0.032 | — | — |
| p | 0.08 | 0.26 | 1.34 | 0.011 | 0.003 | 0.035 | 0.19 | 0.24 |
| q | 0.10 | 0.24 | 1.55 | 0.015 | 0.004 | 0.034 | — | 0.44 |
| r | 0.11 | 0.23 | 1.36 | 0.011 | 0.003 | 0.035 | — | — |
| s | 0.10 | 0.21 | 1.55 | 0.012 | 0.003 | 0.030 | 0.29 | 0.14 |
| t | 0.10 | 0.26 | 1.38 | 0.010 | 0.003 | 0.035 | 0.20 | 0.30 |
| u | 0.10 | 0.24 | 1.54 | 0.009 | 0.003 | 0.030 | — | — |
| v | 0.12 | 0.24 | 0.84 | 0.009 | 0.002 | 0.059 | 0.18 | 0.11 |

| | Cr | Mo | Nb | V | Ti | Ca | (wt %) B |
|---|---|---|---|---|---|---|---|
| a | — | — | — | — | — | — | — |
| b | 0.10 | — | 0.022 | — | — | — | — |
| c | — | 0.19 | 0.024 | — | 0.011 | 0.0039 | — |
| d | — | — | — | — | — | — | — |
| e | — | — | — | — | — | — | — |
| f | 1.19 | — | — | — | — | — | — |
| g | — | 0.54 | — | — | — | — | — |
| h | — | — | 0.085 | — | — | — | — |
| i | — | — | — | 0.075 | — | — | — |
| j | — | — | — | — | 0.11 | — | — |
| k | — | — | — | — | — | 0.0030 | — |
| l | — | — | — | — | — | — | — |
| m | 0.19 | 0.24 | — | — | — | — | — |
| n | — | — | 0.019 | 0.044 | — | — | — |
| o | — | — | 0.051 | — | 0.009 | — | — |
| p | — | — | 0.030 | — | — | — | — |
| q | — | — | 0.029 | 0.054 | — | — | — |
| r | 0.19 | 0.17 | — | 0.042 | — | — | — |
| s | — | — | 0.017 | 0.041 | — | — | — |
| t | 0.14 | 0.28 | — | — | — | — | — |
| u | — | — | 0.040 | 0.062 | 0.019 | 0.0035 | — |
| v | 0.72 | 0.35 | — | — | — | — | 0.0011 |

TABLE 4

| | Steel No. | Steel gage (mm) | Heating temp. (°C.) | Finishing roll temp. (°C.) | 900° C.~$Ar_3$ Cumulative reduction (%) | Temp. at which cooling is stopped (°C.) | Cooling water volume density ($m^3/m^2$.min) | Reheating temp. (°C.) | Tempering temp. (°C.) | Yield point ($kg/mm^2$) | Tensile strengths ($kg/mm^2$) | Yield ratio (%) | vTrs (°C.) |
|---|---|---|---|---|---|---|---|---|---|---|---|---|---|
| This invention | a1 | 60 | 1050 | 800 | 40 | RT | 0.7 | 760 | 450 | 35.4 | 57.1 | 61 | −85 |
| Comparison | a2 | " | 1200 | " | " | " | " | " | " | 36.2 | 57.5 | 63 | −57 |
| Comparison | a3 | " | 1050 | 850 | 15 | " | " | " | " | 34.1 | 56.8 | 60 | −55 |
| Comparison | a4 | " | 1150 | 800 | 45 | 300 | " | " | " | 37.3 | 57.4 | 65 | −50 |
| Comparison | a5 | " | 1000 | " | " | RT | " | 700 | " | 41.7 | 55.6 | 75 | −67 |
| Comparison | a6 | " | " | " | " | " | " | 880 | " | 42.5 | 55.2 | 77 | −68 |
| Comparison | a7 | " | " | " | " | " | " | 760 | 650 | 41.0 | 53.9 | 76 | −80 |
| Comparison | a8 | " | " | " | " | " | " | " | — | 30.8 | 59.8 | 52 | −10 |
| This invention | a9 | 100 | " | " | 50 | " | " | " | 400 | 34.5 | 54.6 | 63 | −80 |
| This invention | b1 | 70 | 1250 | 850 | 45 | " | 1.0 | 770 | 450 | 41.3 | 63.5 | 63 | −84 |
| Comparison | b2 | " | " | " | " | " | " | 880 | " | 46.6 | 60.5 | 77 | −81 |
| Comparison | b3 | " | " | " | " | " | " | 770 | 650 | 47.6 | 61.0 | 78 | −87 |
| This invention | c1 | 80 | 1100 | 800 | 50 | <100 | " | 750 | 400 | 41.2 | 64.3 | 62 | −84 |
| This invention | d1 | 70 | 1050 | " | 45 | " | 1.3 | " | " | 42.4 | 67.3 | 63 | −81 |
| This invention | e1 | " | " | " | " | " | " | " | " | 42.9 | 67.0 | 64 | −105 |
| This invention | f1 | " | " | " | " | " | 1.0 | " | " | 41.6 | 64.0 | 65 | −80 |
| This invention | g1 | 60 | 1100 | 790 | " | " | " | " | " | 34.9 | 54.5 | 64 | −82 |
| This invention | h1 | " | " | " | " | " | " | " | " | 35.5 | 55.5 | 64 | −87 |
| This invention | i1 | " | " | " | " | " | " | " | " | 34.3 | 54.5 | 63 | −82 |
| This invention | j1 | " | " | " | " | " | " | " | " | 34.0 | 54.8 | 62 | −84 |
| This invention | k1 | " | " | " | " | " | " | " | " | 34.4 | 55.5 | 62 | −80 |
| This invention | l1 | " | " | " | " | " | " | " | " | 35.1 | 54.8 | 64 | −87 |
| This invention | m1 | " | " | " | " | " | " | " | " | 34.7 | 54.2 | 64 | −84 |
| This invention | n1 | " | " | " | " | " | " | " | " | 35.4 | 55.3 | 64 | −88 |
| This invention | o1 | " | " | " | " | " | " | " | " | 34.7 | 55.9 | 62 | −86 |
| This invention | p1 | " | " | " | " | " | " | " | " | 35.2 | 57.6 | 63 | −89 |
| This | q1 | " | " | 820 | " | " | 1.5 | " | " | 42.6 | 65.5 | 65 | −83 |

TABLE 4-continued

| | Steel No. | Steel gage (mm) | Heating temp. (°C.) | Finishing roll temp. (°C.) | 900° C.~ $Ar_3$ Cumulative reduction (%) | Temp. at which cooling is stopped (°C.) | Cooling water volume density ($m^3/m^2$.min) | Reheating temp. (°C.) | Tempering temp. (°C.) | Yield point ($kg/mm^2$) | Tensile strengths ($kg/mm^2$) | Yield ratio (%) | vTrs (°C.) |
|---|---|---|---|---|---|---|---|---|---|---|---|---|---|
| invention | | | | | | | | | | | | | |
| This invention | r1 | " | " | " | " | " | " | " | " | 41.9 | 64.4 | 65 | −81 |
| This invention | s1 | " | " | " | " | " | " | " | " | 42.6 | 67.6 | 63 | −80 |
| This invention | t1 | " | " | " | " | " | " | " | " | 40.9 | 63.9 | 64 | −83 |
| This invention | u1 | " | " | " | " | " | " | " | " | 42.0 | 66.7 | 63 | −86 |
| This invention | v1 | 40 | 1050 | 850 | 40 | " | 1.0 | 810 | 450 | 54.0 | 83.0 | 65 | −85 |

Remarks:
In this invention and comparison, steel sheet was cooled by water-cooling roller quenching after reheating.

We claim:

1. A method of producing steel having a low yield ratio comprising heating a low-carbon steel slab having a composition consisting essentially, by weight, of Carbon: 0.30% or less
Silicon: 0.05 to 0.60%
Manganese: 0.5 to 2.5%
Aluminum: 0.01 to 0.10% as the basic components, with the balance being iron and unavoidable impurities, to a temperature of 950° to 1250° C., hot rolling it, quenching it to a temperature not exceeding 250° C., reheating it to a temperature of $Ac_1+20°$ C. to $Ac_1+80°$ C., water-cooling it and then tempering it at a temperature range of 200° to 600° C., whereby the steel is given a two-phase mixed microstructure of ferrite and second-phase carbide.

2. The method according to claim 1 wherein the slab is low-carbon low-alloy steel having a composition consisting essentially, by weight, of Carbon: 0.30% or less
Silicon: 0.05 to 0.60%
Manganese: 0.5 to 2.5%
Aluminum: 0.01 to 0.10% as the basic components and which also contains one or two or more elements selected from among a group of hardness-improvement elements consisting of Copper: 2.0% or less
Nickel: less than 4.0%
Chromium: 5.5% or less
Molybdenum: 2.0 or less
Niobium: 0.15% or less
Vanadium: 0.3% or less
Titanium: 0.15% or less
Boron: 0.0003 to 0.0030% and an effective amount of calcium for inclusion shape control action, with the balance being iron and unavoidable impurities.

3. The method according to claim 1 wherein the hot rolling is finished at a temperature that is over 900° C. and no higher than 1050° C.

4. The method according to claim 1 wherein the hot rolling is finished at a temperature between 900° C. and $Ar_3$, and reduction is performed within this temperature range at a cumulative reduction ratio of from 5% to less than 30% of the finish thickness.

5. The method according to claim 1 wherein the carbon-steel slab is heated to within a temperature range of 950° to 1150° C., and in the hot rolling a cumulative reduction of 30% to 70% is applied at a temperature of 900° C. to $Ar_3$.

6. The method according to claim 2 wherein the carbon-steel slab is heated to within a temperature range of 950 to 1150 degrees Centigrade, and in the hot rolling a cumulative reduction of 30% to 70% is applied at a temperature of 900 degrees Centigrade to $Ar_3$.

* * * * *